US006527649B1

(12) United States Patent
Neher et al.

(10) Patent No.: US 6,527,649 B1
(45) Date of Patent: Mar. 4, 2003

(54) ADJUSTABLE GOLF PUTTER

(76) Inventors: Lloyd A. Neher, Box 12, Marquette, Manitoba (CA), R0H 0V0; John MacDonald, 365 Lindsay Street, Winnipeg, Manitoba (CA), R3N 1H2

( * ) Notice: Subject to any disclaimer, the term of this patent is extended or adjusted under 35 U.S.C. 154(b) by 0 days.

(21) Appl. No.: 09/956,128

(22) Filed: Sep. 20, 2001

(51) Int. Cl.[7] ..... A63B 53/06; A63B 53/02

(52) U.S. Cl. ..... 473/248; 473/313; 473/334; 473/337; 473/314; 473/341

(58) Field of Search ..... 473/305, 306, 473/307, 308, 309, 310, 311, 312, 313, 314, 315, 334, 335, 336, 337, 338, 339, 340, 341, 244, 245, 246, 247, 248, 288

(56) References Cited

U.S. PATENT DOCUMENTS

| | | | | |
|---|---|---|---|---|
| 2,155,830 | A | * | 4/1939 | Howard |
| 4,111,426 | A | * | 9/1978 | Goodwin |
| 4,121,832 | A | | 10/1978 | Ebbing |
| 4,735,414 | A | * | 4/1988 | Williams |
| 5,116,047 | A | | 5/1992 | Phelan et al. |
| 5,253,869 | A | * | 10/1993 | Dingle |
| 5,299,807 | A | | 4/1994 | Hutin |
| 5,332,214 | A | | 7/1994 | Tucker, Sr. |
| 5,390,919 | A | | 2/1995 | Stubbs et al. |
| 5,533,730 | A | | 7/1996 | Ruvang |
| 5,863,257 | A | | 1/1999 | Busnardo |
| 5,924,938 | A | | 7/1999 | Hines |
| 6,019,686 | A | * | 2/2000 | Gray |
| 6,142,884 | A | * | 11/2000 | Yim |

FOREIGN PATENT DOCUMENTS

| | | | | |
|---|---|---|---|---|
| WO | WO90/06157 | * | 6/1990 | ..... 273/80.1 |

* cited by examiner

*Primary Examiner*—Sebastiano Passaniti
(74) *Attorney, Agent, or Firm*—Adrian D. Battison; Michael R. Williams; Ryan W. Dupuis

(57) ABSTRACT

An adjustable golf club comprises an elongate shaft having a handle at one end, a club head having a face arranged to strike a golf ball, a pair removable shaft attaching members each arranged to be coupled to the club head at respective sides of the striking face whereon the shaft extends therefrom. A pair of changeable weights, each one of the weights is arranged to be coupled to a respective one of the shaft attaching members. An insert portion on the club head at respective sides of the striking face for receiving the shaft attaching member. A stem extending from each of the shaft attaching members arranged to extend through the club head whereon the weights are coupled and an adjustable fastening arrangement in the insert arranged such that the angle of the shaft in relation the club head can be changed. The shaft attaching members are arranged to be interchangeable to allow the club to be usable for left or right handed golfers.

4 Claims, 1 Drawing Sheet

ADJUSTABLE GOLF PUTTER

FIELD OF THE INVENTION

The present invention relates to a golf club, more particularly an adjustable golf club.

BACKGROUND

Conventional golf putters have a club head and a rigidly fixed shaft positioned to be used either by left handed or right handed golfers. These conventional putters also have a fixed weight and balance forcing a user to purchase different types of putters to test out with one the golfer prefers.

US Patents:

U.S. Pat. No. 5, 924,938 (Hines)

U.S. Pat. No. 5,863,257 (Busnardo)

U.S. Pat. No. 5,390,919 (Stubbs et al)

U.S. Pat. No. 4,121,832 (Ebbing)

U.S. Pat. No. 5,533,730 (Ruvang)

U.S. Pat. No. 5,299,807 (Hutin)

U.S. Pat. No. 5,332,214 (Tucker, Sr.)

U.S. Pat. No. 5,116,047 (Phelan et al)

are examples of adjustable weighted putters/clubs as well as putters that can be used for left and right handed golfers.

SUMMARY

According to the present invention there is provided an adjustable golf club comprises:

an elongate shaft having a handle at one end;

a club head having a face arranged to strike a golf ball;

a pair removable shaft attaching members each arranged to be coupled to the club head at respective sides of the striking face whereon the shaft extends therefrom;

a pair of changeable weights, each one of the weights is arranged to be coupled to a respective one of the shaft attaching members;

an insert portion on the club head at respective sides of the striking face for receiving the shaft attaching member;

a stem extending from each of the shaft attaching members arranged to extend through the club head whereon the weights are coupled;

an adjustable fastening arrangement in the insert arranged such that the angle of the shaft in relation the club head can be changed;

wherein the shaft attaching members are arranged to be interchangeable to allow the club to be usable for left or right handed golfers.

Preferably each stem is threaded to receive a nut on a respective side of the head for securing each weight and shaft attaching members thereon.

Preferably interchangeable weights consist of a variety of compositions for a variety of weight selections.

Preferably each insert and shaft attaching members have a plurality of corresponding teeth on respective engaging surfaces providing adjustment of the shaft angle.

BRIEF DESCRIPTION OF THE DRAWINGS

In the accompanying drawings, which illustrate an exemplary embodiment of the present invention.

DETAILED DESCRIPTION

Figure 1:
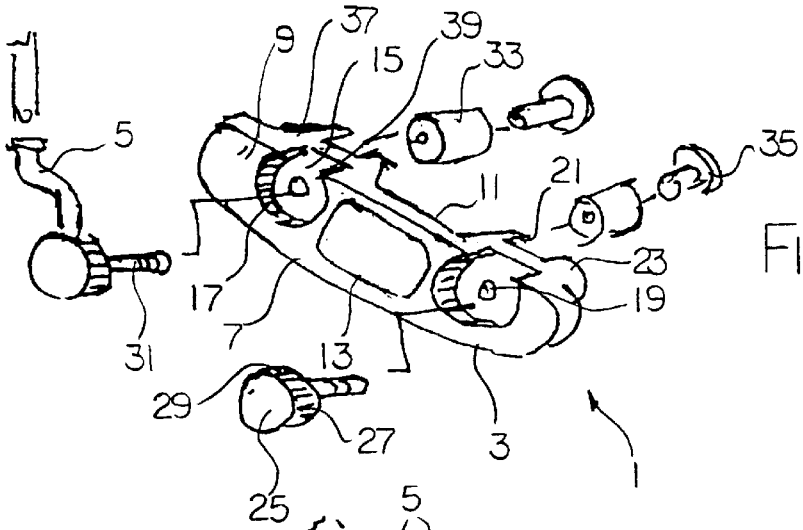
FIG. 1 is an exploded isometric view of the present invention.

Referring to the accompanying drawings, there is illustrated an adjustable golf putter 1. The putter has a club head 3 which is arranged to be changeable for left and right handed people as well as the angle of the club head relative to a shaft 5 is adjustable. The club head has an elongate main body 7 which is arranged to be positioned at an end of the shaft for striking a golf ball. The main body is made of conventional putter material such as metal. The main body has a front face 9 and a rear face 11, similar to that of a conventional putter. The front face has a striking area 13 made of a hardened rubber as found on many conventional putters. On each side of the striking face is an insert portion 15 being circular in shape cast into the front face of the main body. The insert portion has a plurality of notches 17 about its circumference and a hole 19 extending through the main body to the rear face. The hole extends into a receiving portion 21 on the rear face directly opposite each insert portion. The receiving portion has rearwardly extending protrusions 23 spaced radially from the hole.

Figure 2:
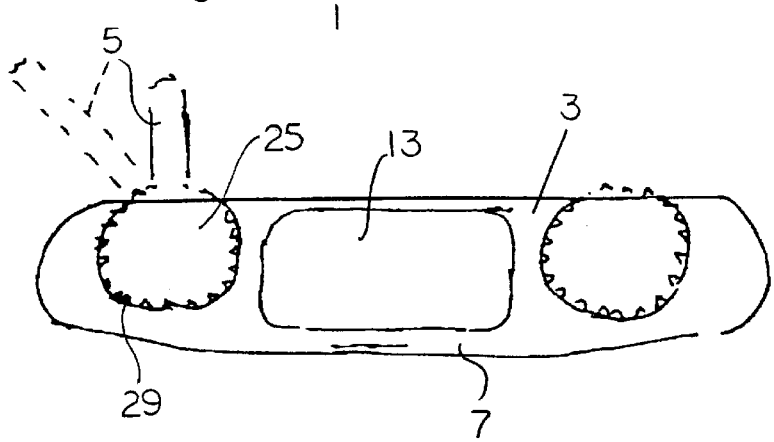
FIG. 2 is a front view of the club head.
Figure 3:
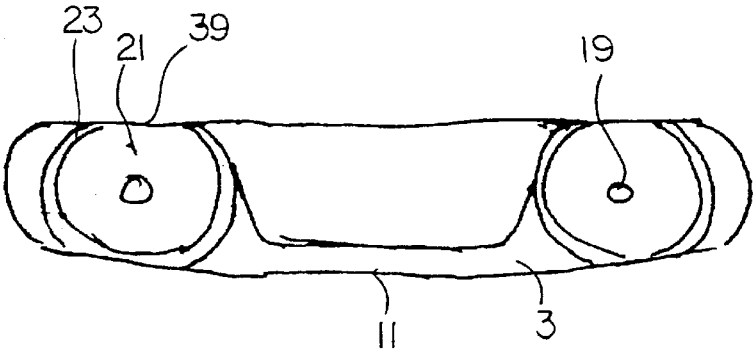
FIG. 3 is a rear view of the club head.
Figure 4:
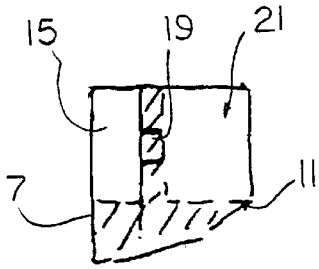
FIG. 4 is a vertical cross section along the lines 4—4 of FIG. 3.

A pair of shaft members 25 being disk shaped having an outer edge 27 which has a plurality of corresponding notches 29 is arranged to be inserted into each of the insert portions. The notches are arranged to correspond with the notches on the insert portion such that the members can be removed and rotated and looked in that position by the notches. The shaft members are interchangeable between the insert portions. One of the shaft members is connected to the shaft. The shaft member can be inserted into either insert portion so that the putter can be changed from right handed use to left handed use and visa versa. The corresponding notches on the insert portion and the shaft members allow the angle of the shaft in relation to the club head to be adjusted, as best shown in FIG. 2. Extending from the shaft members is a stem 31 which is arranged to be inserted through the hole. The stems are threaded and are arranged extend through the hole and into the receiving portion. Weights 33 having an elongate body and arranged to be receiving within the receiving portion have a receiving centre arranged to receiving the stem. The stem is arranged to position the weights at each receiving portion so that the weights can be interchanged for changing the weight and balance of the putter. Caps 35 having corresponding threads are arranged to be tightened onto the stem for fastening the weights between the cap and the rear face and for tightening the shaft members within the insert portion.

The insert portion is arranged such that the shaft members are flush with the front face when positioned therein. A top portion 37 of the main body has slots 39 which are positioned at the insert portion so that the shaft can extend upwards therethrough. The receiving portion is arranged to contain the weight and the cap While one embodiment of the present invention has been described in the foregoing, it is to be understood that other embodiments are possible within the scope of the invention.

The invention is to be considered limited solely by the scope of the appended claims.

What is claimed is:

1. An adjustable golf club comprises:

an elongate shaft having a handle at one end;

a club head having a face arranged to strike a golf ball;

a pair of removable shaft attaching members being spaced apart and arranged to be coupled to the face of the club head at respective sides of a striking face there between;

whereby the shaft extends from one of the shaft attaching members;

a pair of changeable weights, each one of the weights is arranged to be coupled to a respective one of the shaft attaching members;

an insert portion on the club head at respective sides of the striking face for receiving the shaft attaching member;

a stem extending from each of the shaft attaching members arranged to extend through the club head whereon the weights are coupled;

an adjustable fastening arrangement in the insert arranged such that the angle of the shaft in relation to the club head can be changed;

wherein the shaft attaching members are arranged to be interchangeable to allow the club to be usable for left or right handed golfers.

2. The club according to claim 1 wherein each said stem is threaded to receive a nut on a respective side of the head opposite the striking face for securing each said weight and said shaft attaching members thereon.

3. The club according to claim 1 wherein interchangeable weights consist of a variety of compositions for a variety of weight selections.

4. The club according to claim 1 wherein each said insert and said shaft attaching members have a plurality of corresponding teeth on respective engaging surfaces providing adjustment of the shaft angle.

* * * * *